US006729038B2

(12) United States Patent
Lonier

(10) Patent No.: US 6,729,038 B2
(45) Date of Patent: May 4, 2004

(54) ROLLER SQUEEGEE AND SPINNER ADAPTER

(75) Inventor: David-Thornton Lonier, Auburn Hills, MI (US)

(73) Assignee: Paintway Trust, Las Vegas, NV (US)

( * ) Notice: Subject to any disclaimer, the term of this patent is extended or adjusted under 35 U.S.C. 154(b) by 186 days.

(21) Appl. No.: 10/056,177

(22) Filed: Jan. 24, 2002

(65) Prior Publication Data

US 2002/0133967 A1 Sep. 26, 2002

Related U.S. Application Data

(60) Provisional application No. 60/277,693, filed on Mar. 21, 2001.

(51) Int. Cl.[7] ..... F26B 25/20
(52) U.S. Cl. ..... 34/58; 34/240
(58) Field of Search ..... 34/58, 312, 437, 34/440, 240; 15/104.92

(56) References Cited

U.S. PATENT DOCUMENTS

| | | | | | |
|---|---|---|---|---|---|
| 2,616,281 | A | | 11/1952 | Calhoun | |
| 2,794,265 | A | | 6/1957 | Kruger | |
| 2,881,533 | A | * | 4/1959 | Johnson | 34/58 |
| 2,884,709 | A | | 5/1959 | Kruger | |
| 2,912,769 | A | | 11/1959 | Kruger | |
| 3,399,463 | A | * | 9/1968 | Stott | 34/58 |
| 3,925,908 | A | | 12/1975 | Dunn | 34/58 |
| 4,320,550 | A | * | 3/1982 | McGrew | 15/3 |
| 5,185,938 | A | | 2/1993 | Hutt | 34/58 |
| 5,473,823 | A | | 12/1995 | Powell | 34/58 |
| 5,539,948 | A | | 7/1996 | McCauley et al. | 15/105 |
| 5,588,221 | A | | 12/1996 | Hoeltke et al. | 34/58 |
| 5,597,002 | A | | 1/1997 | Stanley, Jr. et al. | 134/149 |
| 5,621,979 | A | | 4/1997 | Taylor | 34/58 |
| D386,857 | S | | 11/1997 | Lawrence | D32/46 |
| 5,784,798 | A | | 7/1998 | Taylor | 34/58 |
| 5,845,403 | A | * | 12/1998 | Nivin | 30/147 |
| 5,873,176 | A | | 2/1999 | Richards | 34/58 |
| 6,038,787 | A | | 3/2000 | Dean et al. | 34/312 |
| 6,073,362 | A | | 6/2000 | Dean et al. | 34/58 |
| 6,115,935 | A | * | 9/2000 | Collins et al. | 34/58 |
| 6,163,975 | A | | 12/2000 | Michelsen | 34/58 |
| 6,280,531 | B1 | | 8/2001 | Galbreath | 134/6 |

* cited by examiner

*Primary Examiner*—K. B. Rinehart
(74) *Attorney, Agent, or Firm*—John A. Miller; Warn, Burgess & Hoffman, P.C.

(57) ABSTRACT

A roller squeegee and spinner adapter tool is disclosed for safely, easily, speedily and thoroughly removing paint or other coating material from a roller by squeegeeing or sliding the major bulk of paint from the roller and then attaching a mini-roller to a paintbrush and roller spinner for conveniently removing residual paint and cleaning solution from the mini-roller via the spinning action (centrifugal force) of the spinner.

14 Claims, 2 Drawing Sheets

ROLLER SQUEEGEE AND SPINNER ADAPTER

CROSS REFERENCE TO RELATED APPLICATION

This application claims priority from U.S. Provisional Application No. 60/277,693 Filing Date: Mar. 21, 2001.

BACKGROUND OF INVENTION

Prior to the late 1950s and the invention of the paintbrush and roller cover spinner, paintbrushes and roller covers were cleaned by hand. The procedure for cleaning roller covers, generally consisted of a time consuming process of using a paint stick or putty knife to scrape the initial bulk of paint or other coating material from the roller, then washing, rinsing, and squeezing in a solvent of the same base as that of the paint, repeating the process as needed, then shaking to remove as much paint and solvent as possible and then setting the brush or roller cover on a well drained surface to dry. There was no quick, easy or efficient method of removing the paint and solvent from the brush or roller cover.

One problem with the roller cleaning process, as suggested above and which persists today, is that of the initial removing of the bulk of the paint remaining in the roller after application and prior to rinsing and spinning. This has traditionally been accomplished by stabilizing the roller while still in its handle/frame, in a near vertical position, holding the frame with one hand and positioning the end of the roller extending from the frame either onto the surface of a roller pan or into a bucket. The roller is then scraped using a wooden paint stirring stick, putty knife or a (5 in 1) tool, which has a half circle notch cut into a flat blade (U.S. Pat. No. Des 386,857), specifically designed for scraping paint from roller covers. The process entails holding the roller frame with one hand and holding the scraping tool in the other hand and placing firm pressure against the roller cover with the tool. Next the tool is dragged from top to bottom, parallel to and along the longitudinal axis of the roller cover. The tool's edge is held at an angle slightly off 90° to the long axis and surface of the roller, causing a build-up of paint just ahead of the tool in the direction of motion as it travels toward the bottom end of the roller. The roller is then rotated slightly and the scraping/rotating process is repeated until the bulk of the paint has been removed.

Most tools presently used for the above-mentioned scraping process have fairly sharp edges or corners and cause considerable damage to the nap and deformation of the roller, which remains even after the roller is thoroughly rinsed and spun out. This leaves the roller nap matted and irregular, inhibiting its ability to absorb and apply paint evenly. The scraping process also causes nap fibers to become dislodged, not only contributing to deformity of the roller, but also imparting bits and pieces of fiber in the paint which has been removed, leaving it unsuitable for re-use. This has become such a problem that many, skilled in the art, skip the scraping process altogether. Needless to say, a sizeable amount of paint or other coating material is either diluted in large quantities of solvent or flushed into our municipal drainage systems.

The paintbrush and roller cover spinner, (U.S. Pat. Nos. 2,794,265, 2,884,709 and 2,912,769), which involves one aspect of the present invention is a hand held device consisting of a tubular housing into which is longitudinally inserted a spiral shaped rod with a handle on one end and a rotating set of cylindrically shaped spring steel clamps at the other end. These rotating spring clamps were originally designed to grasp the handle of a paintbrush or to provide a cylinder over which a standard 1½" i.d. roller cover is slid. This device has become a necessity for most professional painters, in that it saves time and greatly improves the efficiency of cleaning brushes and roller covers.

The procedure for using the spinner consists of first thoroughly rinsing the brush or roller cover in a solution of the same base as that of the paint, ie. water, mineral spirits, etc. Next, the brush or roller cover is secured to the clamping mechanism at the bottom end of the spinner when held in a vertical position, and then positioned within the confines of a bucket or tub. With one hand holding the spinner's tubular housing, the handle at the top end of the spinner is grasped with the other hand and pumped in and out of the housing vigorously. This in turn exerts a rapid spinning motion upon the brush or roller cover, thereby expelling paint and cleaning solution by centrifugal force. This process leaves the brush or roller cover in a nearly paint-free and nearly dry condition and instantly ready for re-use.

The spinner was originally intended for cleaning paintbrushes and standard 1½" diameter roller covers, which could be attached directly to it. However, there presently exists a type of paint roller (mini-roller) which, because its configuration is unlike that of a paintbrush or a standard roller cover, cannot be attached directly to the spinner. To apply the above-described spin-cleaning process to a mini-roller, an adaptive device must be used to attach the mini-roller to the spinner. Various prior inventions have attempted to solve this problem with limited degrees of success.

Prior inventions (U.S. Pat. Nos. 5,473,823; 5,597,002 and 5,163,975) have failed to include a means whereby any force would be added beyond the pinching action of the spinner clamps against their straight cylindrical shaft, to increase the adapter's adhesion to the spinner. This added adhesion would be desirable in that the high velocity spinning motion in a downward vertical position has a tendency to loosen the adapter/mini-roller from the spinner. An attempt to solve this problem has been disclosed in (U.S. Pat. No. 6,073,362) providing an annular ribbing of the surface of the handle portion, which inserts into the spinner clamps. Although this increases the retention of the adapter within the spinner clamps, it also causes considerable resistance when attaching and detaching adapter and spinner. This undue resistance to insertion and removal is further made difficult since very little surface area is available for grasping the adapter, especially when it is fully inserted within the spinner's retaining clamps. This also causes the user's hands and fingers to come dangerously close to the powerful pinching action between clamps and adapter.

Several of these same prior inventions (U.S. Pat. Nos. 5,597,002; 5,539,948 and 6,073,362) have failed to take advantage of a small diameter hole located at the center of the base of a hand-operated spinner's clamping receptacle. The inventor of the present invention is unaware of any spinner, which does not incorporate such a hole in its design. In order to utilize this feature, it would be necessary to specifically design an adapter's tip on the elongate handle portion which is to be inserted into the spinner, in such a way as to be received and stabilized within the hole. Two other prior inventions (U.S. Pat. Nos. 5,473,823 and 6,163,975) which vaguely allude to this possibility, fail to make any specific claim for its application in their invention.

Other prior inventions (U.S. Pat. Nos. 2,616,281; 3,925,908; 5,185,938; 5,539,948; 6,038,787 and 6,073,362) are designed to utilize an electric power drill for their spinning and expelling process. However, in testing this application, the inventor of the present invention has found it to be unsatisfactory in that: 1. unlike the hand-operated spinner, most power drills rotate at speeds too low for expelling paint and solvent, especially noticeable when applied to small diameter rollers; 2. because of a power drill's use in close proximity to water and volatile solvents, sparks from its motor could cause injury to the user from electrical shock or combustion; and 3. since a source of AC electricity would be necessary to operate a high speed drill (cordless drills have slow rotation), this may present an inconvenience.

With an ever-increasing use of rollers for applying paint and other coating materials, there presently exists a need for a uniquely designed tool, which will assist in easily, efficiently, rapidly and thoroughly cleaning all such rollers, while minimizing or eliminating any adverse effects upon either the roller or paint.

BRIEF SUMMARY OF THE INVENTION

The present invention provides a squeegee/adapter tool which will enable one skilled in the art to rapidly, safely, easily and thoroughly remove paint or other coating material from a roller, utilizing a non-invasive squeegeeing and spinning procedure, assuring the roller's continued usefulness and longevity.

One object of the present invention is to utilize a small diameter rod extending to one end of the tool's overall elongated form, as a squeegee to push or slide paint from a roller without imparting damage to its fibers and nap, or dislodging fibers into the removed paint.

Another object of the invention is a unique torpedo shape extending to one side of its overall elongated form, which serves to provide ease of insertion into and removal from the clamps of a spinning device, and to lock, center and stabilize the tool within the spinner's clamping receptacle. This shape also serves as a comfortable handle when the tool is used as a squeegee.

In another aspect of the invention, a flange, or hand-hold, similar to a cabinet pull, is incorporated into the design, whereby the tool can be comfortably and safely grasped when inserted into or removed from the spinner. This same flange acts as a barrier to protect the user's hand from coming in contact with paint or other coating material when the tool is used as a squeegee.

Another aspect of the invention is realized in the uniquely calibrated "rod" end, or small diameter section of the overall elongated tool's form, which has a very slight increasing curved taper which, in combination with its smooth surface, facilitates a secure attachment of a mini-roller to the adapter and ease of removal there from.

It is yet another object of the invention to minimize the cost of manufacture. Although not limited to any specific material or method of manufacture, the tool's design lends itself to an inexpensive one-piece injection molding process.

BRIEF DESCRIPTION OF THE DRAWINGS

The above aspects as well as other innovative features of the invention are presented in the following detailed description with references to the attached drawings in which.

DETAILED DESCRIPTION

Figure 1:
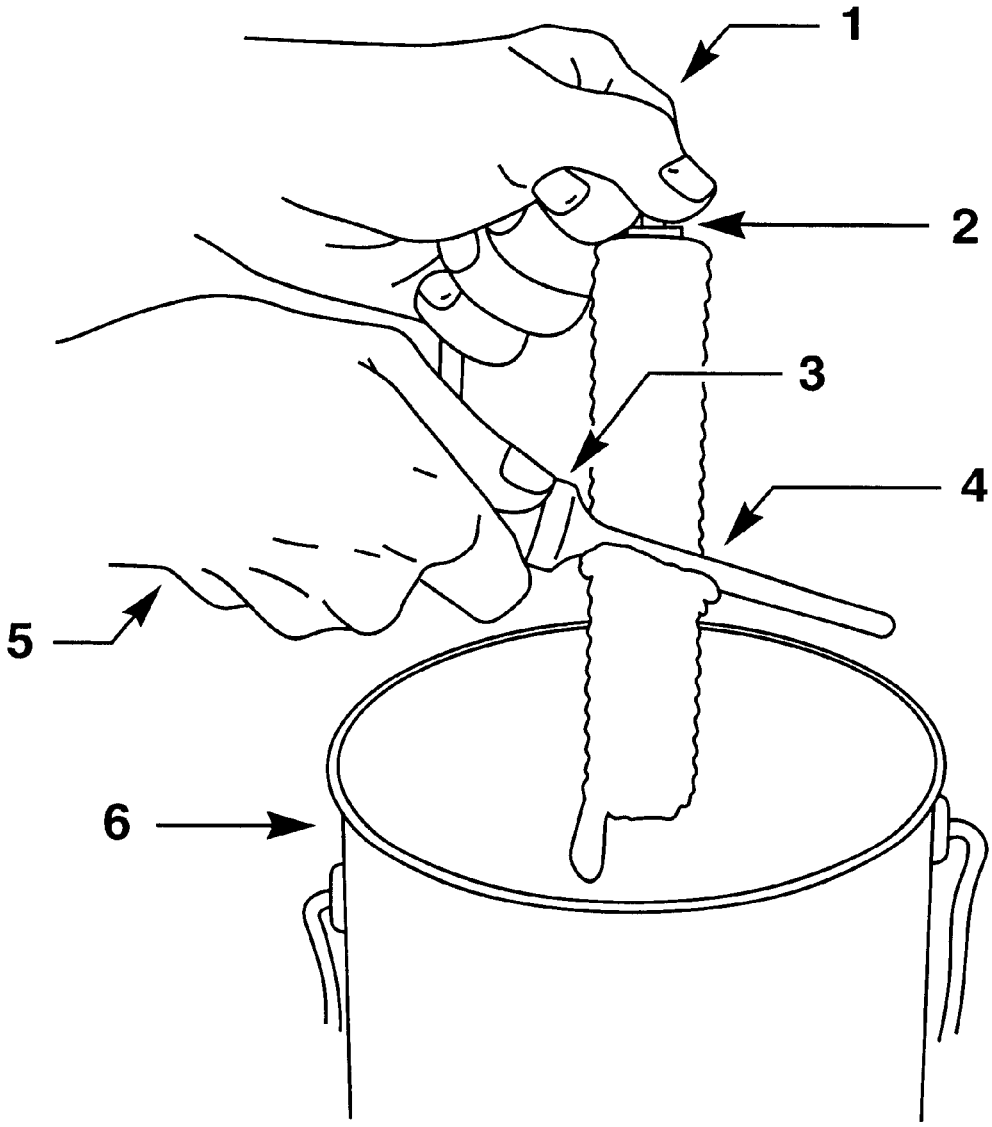
FIG. 1 is a perspective view of the present invention (squeegee/adapter) being used as a squeegee to remove paint from a roller.
Figure 3:
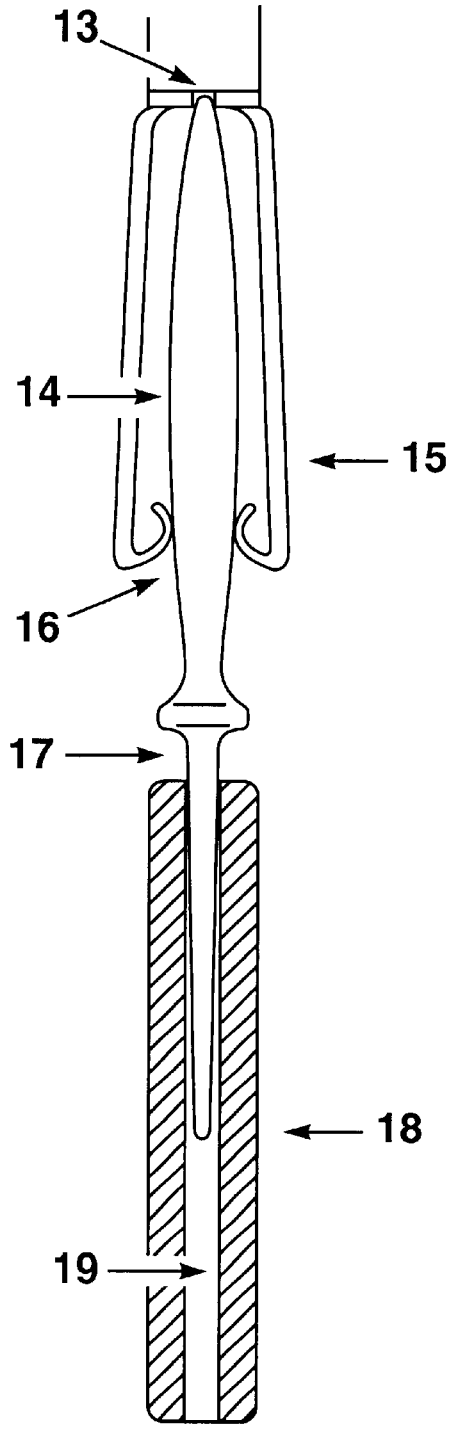
FIG. 3 is a vertical profile view showing the squeegee/adapter securing a mini-roller (in cross-section) to a spinner within its clamps and receptacle.

In referencing the attached drawings, various aspects of the invention will be so described as to enable one skilled in the art to use and/or produce the invention. A unique feature of the invention is its use as a squeegee FIG. 1, in which the initial bulk of paint remaining on a roller after use, is squeegeed or slid off the roller 4. Another aspect of the invention is its use as an adaptation device whereby a mini-roller can be attached to a paintbrush and standard roller cover spinner for ease, speed, and thoroughness of cleaning FIG. 3.

The procedure for using the device involves first, removing the major portion of paint remaining on the roller after use. This is easily accomplished by gripping the roller frame with one hand 1 while still attached to the roller 2, and positioning the roller in a near vertical position over a bucket 6 or roller pan. The handle 7 of the squeegee/adapter is then grasped in the other hand 5, held at approximately 90° to the longitudinal axis of the roller, wherein the rod portion 8 is pressed firmly against the roller nap 4 and dragged in a downward direction, pushing the paint toward and off the bottom end of the roller FIG. 1. The roller is then rotated slightly on its longitudinal axis and the above process is repeated until the majority of the paint has been removed. By using the device in this way, it will become apparent to the user that because of the squeegee's absence of sharp edges or corners, the fibers and nap of the roller are virtually undisturbed, leaving no fiber residue in the removed paint and no distortion to the roller, both of which occur with most conventional scraping devices. This process safely and effectively removes most of the paint from the roller, preparing it for the rinsing and spinning process. Another feature of the tool, when used as a squeegee, is the flange 3 separating the handle end from the rod/squeegee end, which acts as a barrier to direct paint away from the user's hand. The above procedure can be utilized to clean either a standard (1½" i.d.) roller cover or a mini-roller. If used with a standard roller cover, the following procedure is unnecessary since the standard roller cover attaches directly to a spinner.

Figure 2:
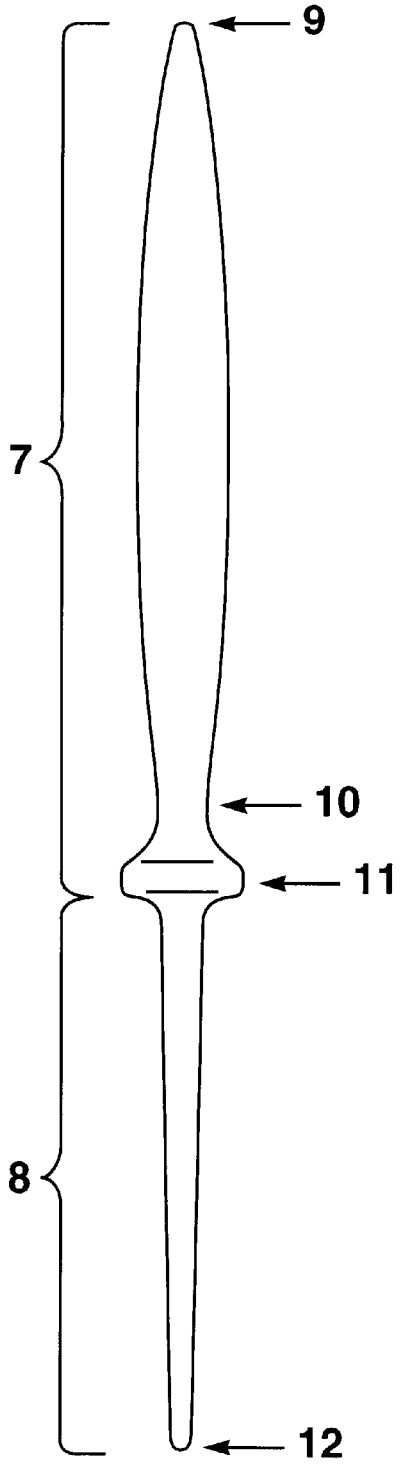
FIG. 2 is a vertical profile view of the symmetrical, cylindrical, compound curve shaped squeegee/adapter.

The next procedure after removing the bulk of the paint from a mini-roller is to thoroughly rinse the roller in a solvent of the same base as that of the paint. Next the adapter FIG. 2 is inserted into the spinner receptacle 16, whence the tip 9 of the adapter is inserted into a slightly larger diameter hole 13 in the base of the spinner receptacle and is thus securely centered and firmly held in place by spring clamps 15. Next the squeegeed and well-rinsed mini-roller 18 is attached to the adapter FIG. 2 by simply slipping the roller onto a slightly tapered rod 8, extending to one end of the adapter. Because of the slight taper of the rod, as it is inserted deeper into the hollow shaft 19 running lengthwise through the center of the roller 18, its fit tightens as the roller is pushed further onto the rod, thus securing it to the adapter 17. These procedures may be performed in any order.

Lastly, the spinner is grasped with one hand by its tubular housing into which is longitudinally inserted a spiraling rod with a handle at one end. The handle of the rod is grasped with the other hand and vigorously pumped in and out of the tubular housing. This action spins the receptacle at a very high velocity, transferring the centrifugal force to the adapter and roller, thereby expelling paint and cleaning solvent. If performed with moderate care, this procedure will leave the roller paint free and nearly dry with an evenly textured fluffed nap, appearing much as it did prior to use.

The larger diameter section 7, because of its gently flowing torpedo shape, allows for a nearly effortless attachment to and removal from the spinner 16. This section has a calibrated tip 9, which, when inserted into a hole 13 at the base of the spinner receptacle, along with the strong gripping force of the spring clamps 15, perfectly centers, locks and stabilizes the adapter within the spinner receptacle. Furthermore, the noted torpedo shaped section 7 is intended to insert 16 into the spinner receptacle so that its largest diameter 14 is between the contact points of the clamps 16 and the base of the receptacle 13. This causes the spinner clamps to force the adapter slightly inward when fully inserted, reducing any tendency for the adapter to loosen when rotated in a downward vertical direction at high speed. This same torpedo shape 7 also provides a comfortable handle for gripping the device when used as a squeegee 5.

From its smallest diameter 10, the torpedo shape abruptly flows to form a flange 11, similar to a drawer or cabinet pull knob. This form, besides acting as a barrier to prevent paint from coming in contact with the user's hand when the device is used as a squeegee 3, also can be comfortably grasped, to facilitate the adapter's insertion into, and removal from, the spinner. This integrated symmetrical design lends itself to a perfectly balanced, wobble free action when the receptacle, adapter and roller are rotated at a high speed.

The smaller diameter rod section 8, to which the mini-roller is attached 17, is designed with a slight taper, the diameter of which increases slightly as its measurement moves from tip 12 to flange 11. This taper acts as a wedge to firmly secure the roller 18 to the adapter 17, as the tapered rod is inserted deeper into the hollow shaft 19 running lengthwise within the center of the mini roller.

The present invention possesses a unique simplicity of design. Eliminated from the tool's overall structure are any extraneous elements such as ribbing, clips, knurling or optional multi-material construction. The tool integrates into its structure an economy of design elements which serve a vast array of functions.

As above described, a roller squeegee and spinner adapter tool is provided. This tool will enable a user to safely, easily, speedily and thoroughly rid a standard roller cover or mini-roller of paint or other coating material and solvent thus assuring its continued usefulness and longevity. Further, the heretofore specified uses, advantages and unique features may not represent all applications of the principles of the present invention. Numerous modifications, alternative arrangements and variations may be devised by those skilled in the art without departing from the spirit and scope of the invention. The appended claims are here put forth to disclose the tool's many uses, arrangements, variations and modifications.

What is claimed is:

1. A painter's tool comprising a cylindrical elongated member including a handle portion, a squeegee portion and an annular flange, said handle portion including a first end and a second end separated by a center portion, said center portion having a larger diameter than the diameter of the first end and the diameter of the second end of the handle portion so that the entire length of the handle portion has a continuous bulbous shape, said second end of the handle portion being coupled to the flange, said squeegee portion including a first end and a second end, said squeegee portion having a tapered configuration where the first end of the squeegee portion is coupled to the flange and has a larger diameter than the diameter of the second end of the squeegee portion, wherein the handle portion is adapted to be clamped to a spinner device and wherein the squeegee portion is adapted to be secured within a center bore of a paint roller by a friction engagement.

2. The tool according to claim 1 wherein the annular flange has a larger diameter than the diameter of the second end of the handle portion and the diameter of the squeegee portion.

3. The tool according to claim 1 wherein the elongated member is a single piece member.

4. The tool according to claim 3 wherein the elongated member is a single piece plastic molded member.

5. The tool according to claim 1 wherein the first end of the handle portion is shaped to fit within a receptacle in the spinner device.

6. The tool according to claim 1 wherein an outer surface of the squeegee portion is a smooth surface.

7. The tool according to claim 1 wherein the taper of the squeegee portion is an increasing curved taper from the second end of the squeegee portion to the first end of the squeegee portion.

8. The tool according to claim 1 wherein the annular flange has a larger diameter than the diameter of the center portion of the handle portion.

9. A painter's tool comprising a cylindrical elongated member including a handle portion, a squeegee portion and an annular flange, said handle portion and said squeegee portion being coupled to the flange, said handle portion including a first end and a second end separated by a center portion, said center portion having a larger diameter than the diameter of the first end and the diameter of the second end of the handle portion so that the entire length of the handle portion has a continuous bulbous shape, said second end of the handle portion being coupled to the flange, said squeegee portion including a first end and a second end, said squeegee portion having a tapered configuration where the first end of the squeegee portion is coupled to the flange and has a larger diameter than the diameter of the second end of the squeegee portion, said annular flange having a larger diameter than the diameter of the second end of the handle portion and a diameter of the squeegee portion, wherein the first end of the handle portion is shaped to fit within a receptacle in a spinner device and the handle portion is adapted to be clamped to the spinner device, and wherein the squeegee portion is adapted to be secured within a center bore of a paint roller by a friction engagement.

10. The tool according to claim 9 wherein the taper of the squeegee portion is an increasing curved taper from the second end of the squeegee portion to the first end of the squeegee portion.

11. The tool according to claim 9 wherein an outer surface of the squeegee portion is a smooth surface.

12. The tool according to claim 9 wherein the elongated member is a single piece member.

13. The tool according to claim 12 wherein the elongated member is a single piece plastic molded member.

14. The tool according to claim 9 wherein the annular flange has a larger diameter than the diameter of the center portion of the handle portion.

* * * * *

UNITED STATES PATENT AND TRADEMARK OFFICE

CERTIFICATE OF CORRECTION

PATENT NO. : 6,729,038 B2
DATED : May 4, 2004
INVENTOR(S) : David-Thornton Lonier It is certified that error appears in the above-identified patent and that said Letters Patent is hereby corrected as shown below:

Column 6,
Line 3, after "device" insert -- where the bulbous shape of the handle portion locks the adapter to the spinner device, --.
Line 45, after "device" insert -- where the bulbous shape of the handle portion locks the adapter to the spinner device --.

Signed and Sealed this

Second Day of November, 2004

JON W. DUDAS
*Director of the United States Patent and Trademark Office*